US005759451A

United States Patent [19]

Tomasiak et al.

[11] Patent Number: 5,759,451

[45] Date of Patent: *Jun. 2, 1998

[54] HUMIDIFIER HAVING MULTI-STAGE FANS

[75] Inventors: Mark J. Tomasiak, O'Fallon; Terrence L. Stanek, St. Charles, both of Mo.; John F. Moody, Bunker Hill, Ill.

[73] Assignee: Emerson Electric Co., St. Louis, Mo.

[ * ] Notice: The term of this patent shall not extend beyond the expiration date of Pat. No. 5,573,713.

[21] Appl. No.: 609,467

[22] Filed: Mar. 1, 1996

Related U.S. Application Data

[63] Continuation of Ser. No. 466,584, Jun. 6, 1995, Pat. No. 5,573,713.

[51] Int. Cl.[6] ..... B01F 3/04

[52] U.S. Cl. ..... 261/23.1; 261/107; 261/120; 261/26; 261/DIG. 3; 55/226

[58] Field of Search ..... 261/23.1, 24, 104, 261/107, 120, 26, DIG. 3; 55/226

[56] References Cited

U.S. PATENT DOCUMENTS

| | | | |
|---|---|---|---|
| D. 337,634 | 7/1993 | Copland et al. | D23/356 |
| 2,445,908 | 7/1948 | De Flon et al. | 261/23 |
| 2,764,451 | 9/1956 | Muller | 299/63 |
| 2,887,307 | 5/1959 | Koch | 261/24 |
| 3,043,573 | 7/1962 | Chandler | 261/24 |
| 3,243,166 | 3/1966 | Osenga et al. | 261/23 |
| 3,253,820 | 5/1966 | Seil | 261/27 |
| 3,304,066 | 2/1967 | Vieceli et al. | 261/29 |
| 3,337,196 | 8/1967 | McCoy et al. | 261/229 |
| 4,022,853 | 5/1977 | Schulenberg | 261/23 |
| 4,698,188 | 10/1987 | Gutmann | 261/107 |
| 4,699,737 | 10/1987 | Engstrand | 261/24 |
| 4,865,775 | 9/1989 | Steiner et al. | 261/24 |
| 5,019,300 | 5/1991 | Davis et al. | 261/23.1 |
| 5,034,162 | 7/1991 | Chiu | 261/24 |
| 5,037,583 | 8/1991 | Hand | 261/26 |
| 5,067,169 | 11/1991 | Chiu | 392/406 |
| 5,110,511 | 5/1992 | Hand | 261/104 |
| 5,133,904 | 7/1992 | Pepper | 261/24 |
| 5,250,232 | 10/1993 | Pepper | 261/24 |
| 5,285,654 | 2/1994 | Ferdows | 261/DIG. 4 |

FOREIGN PATENT DOCUMENTS 718929 11/1954 United Kingdom .

OTHER PUBLICATIONS

Groupe 21/Tools For The Art of Living Well/Aquamat Products For Healthy Breathing Air.

*Primary Examiner*—Tim R. Miles

*Attorney, Agent, or Firm*—Polster, Lieder, Woodruff & Lucchesi

[57] ABSTRACT

A humidifier is disclosed having operation, speed, and humidity control for the distribution of humidified air. The humidifier contains a multiplicity of air moving devices, e.g., fans, to enable large quantities of humidified air to be distributed in an area or conversely, only a small amount of humidified air to be distributed in the area in order to maintain the humidity level already achieved. The humidifier requires only the power necessary to achieve or maintain the level desired without excess use of power. At least one operating control is used to selectively operate one or all of the air moving devices, and at least one speed control is also preferably used with the operating control for selectively increasing or decreasing the speed of one or all of the air moving devices. Along with the operating control and speed control, a humidity control may pre-select humidity between a predetermined minimum and maximum. Furthermore, the level of fan noise may be substantially reduced when the number of air moving devices are reduced and/or decreased in speed.

22 Claims, 5 Drawing Sheets

HUMIDIFIER HAVING MULTI-STAGE FANS

CROSS REFERENCE TO RELATED APPLICATIONS

This is a continuation of patent application Ser. No. 08/466,584 filed Jun. 6, 1995 entitled HUMIDIFIER HAVING MULTI-STAGE FANS, now U.S. Pat. No. 5,573,713.

BACKGROUND OF THE INVENTION

The present invention relates to a humidifier which provides a fine control for the distribution of humidified air.

Humidifiers are principally used during the winter season to add moisture to room air. As is well known, heated rooms tend to have a low moisture content which can cause a number of problems. These problems include health problems and discomfort to occupants of the room, as well as the drying out of furniture, and excessive static electricity. With respect to personal health and comfort, humidified air can make the air feel warmer at relatively cool temperatures. Also humidified air protects the respiratory system of the body aiding the body's defenses against viruses and air pollutants. The moisture a humidifier supplies to heated air can help cold sufferers feel better by reducing dryness and irritation in the nose and throat. Humidification of dry air can also alleviate atopic dermatitis attributable to the dry air. A humidifier also may reduce static electricity, protect wood furniture as well as paneling and fabrics and may even protect computers from excessively dry warm air.

While there is general agreement on the many advantages provided by humidified air, there is some disagreement on the type of humidifier that is the most efficient for a given circumstance.

Recently developed humidifiers tend to have a water reservoir or water wicking element so as to increase the moist surface area thereby allowing more water to evaporate and become water vapor to moisturize the air. The wicking element is particularly suitable for a console humidifier or table humidifier and allows the humidifier to be smaller in overall size because more moist air is formed in a shorter period of time.

Although humidifiers have been provided for some time, the average humidifier either provides too much humidity or requires too much power to maintain a predetermined humidity level. When placing a humidifier in an area where the humidity level is low, the humidifier needs to be able to provide humidified air for distribution in the area somewhat rapidly. Improved humidifiers have been developed which provide moist air in adequate portions in relatively small humidifiers. This requires movement of a substantial quantity of air rather quickly and hence, requires a fan of adequate size. On the other hand that fan may not be able to reduce its speed sufficiently to provide only that amount of humidified air needed to maintain the desired humidity level. For instance, the typical fan motor provided to move the humidified air from the humidifier into the surrounding room atmosphere quickly is of a size which requires a minimum size of the fan motor to provide the starting torque. This minimum size drives the fan at too high a level to provide the slow speed the humidifier requires when only maintenance of the humidity is desired. Consequently, the humidity of the area may be maintained at too high a level and the extra power utilized is wasted. Furthermore, a fan of adequate size to transport enough moist air to humidify an area rapidly will have fan blades sufficiently large to result in a noise often found annoying.

SUMMARY OF THE INVENTION

The present invention provides a humidifier having a water reservoir, a humidification system for converting water from the water reservoir into moist air and at least two air moving devices mounted relative to the humidification system for transporting the moist air outside the humidifier. The at least two air moving devices are staged from a low moist air transport to a high moist air transport, or from a high moist air transport to a low moist air transport. In an example, the present invention provides a humidifier with a multiplicity of fans to allow close control of the flow of moist air into the area. The humidifier is comprised of a water reservoir with at least two fans suitably situated to draw moist air from the reservoir surface and transport the moist air into the surrounding space, the multiple fans being staged to provide from very low moist air transport to significantly high moist air transport and vice versa. The multiplicity of fans allows one or more fans to function simultaneously providing for varying amounts of moist air to be transported. Smaller fans can be used and when only one fan is used it allows only a small amount of moist air to be transported whereas when two or more fans are used simultaneously relatively large amounts of moist air are transported. By being able to transport only a small amount of moist air when utilizing only one fan, the humidifier is able to maintain a predetermined level of humidity using less power than heretofore and with substantially no noise.

For example, a conventional fan could move a large amount [e.g., about 1000 cubic feet per minute (cfm)] of moist air but the slow speed of the fan would move too much moist air for maintenance of an already attained desirable level of humidity. The requirements to maintain the humidity of the room at the desired level may only be only a small amount of moist air. Thus too much air is moved by the fan thereby wasting power and perhaps over humidifying the area. By use of two fans, or more, the present invention can provide transport of moist air at a low rate up to a high rate thereby providing a full range of transport values utilizing no more than the same amount of power or in most instances, less power. Smaller fans create less noise and hence in general, the noise level is significantly reduced.

DETAILED DESCRIPTION OF THE INVENTION

Figure 1:
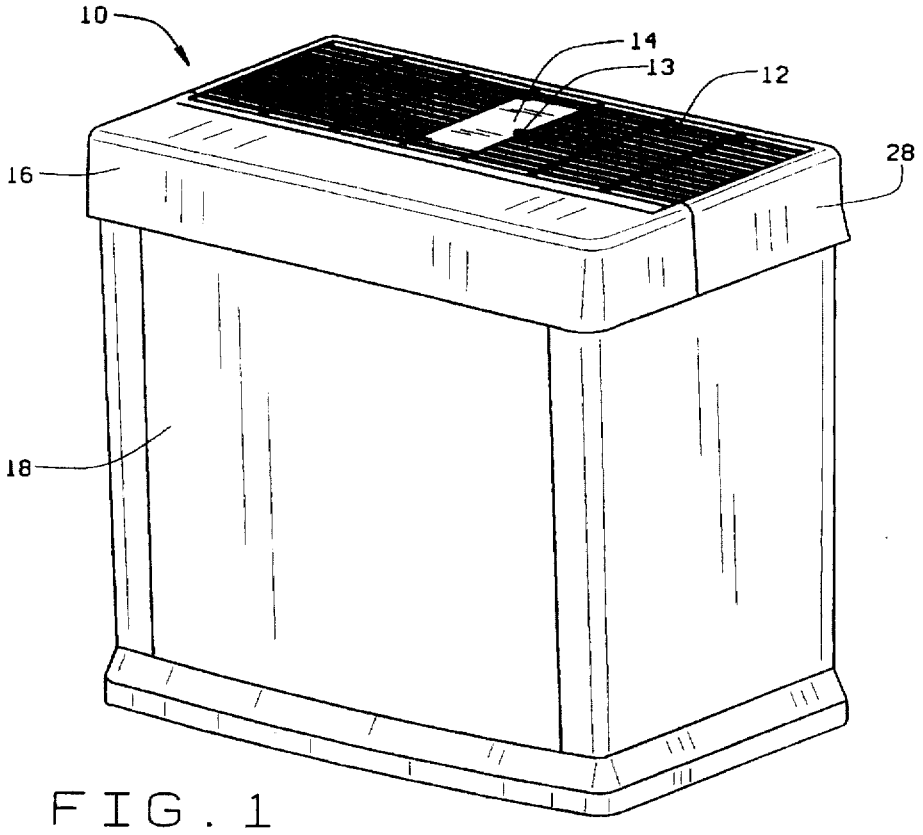
FIG. 1 is a perspective view of one embodiment of the present invention.

FIG. 1 depicts a room humidifier 10 having a top 28 of which the front portion 16 is hinged so as to be easily lifted up to expose water storage bottles below. The lid 28 has a louvered portion 12 to permit moist air to exit the humidifier 10. In the center of the lid 28 is a panel 14 covering the electronic controls of the humidifier 10. The panel 14 is hinged and has a notch 13 to provide a finger lift portion so as to be easily raised exposing the electronic controls. The cabinet 18 of the humidifier 10 provides an enclosure of the component parts of the humidifier 10. The interior of the cabinet 18 serves as a reservoir for the water which evaporates to provide the moist air.

Figure 2:
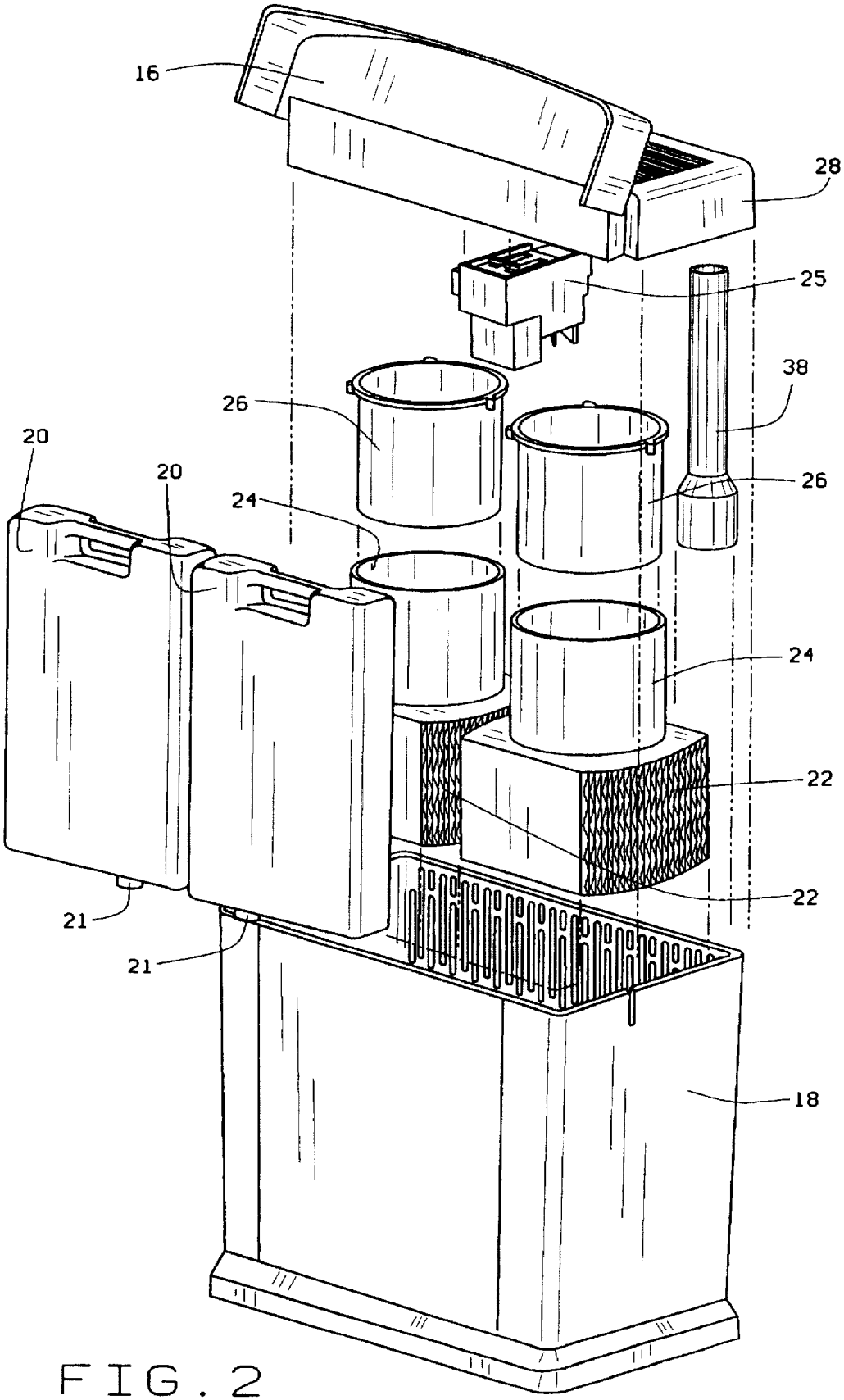
FIG. 2 is an exploded view of the embodiment of FIG. 1.

FIG. 2 is an exploded view of the humidifier of FIG. 1. The lid 28 shows the forward portion 16 opened which would expose the storage water bottles 20 so that they may be removed, filled and placed back in position to supply water to the reservoir inside the cabinet 18. Each bottle 20 has a dispensing cap 21 which is part of a valve system (not shown) which meters the water into the reservoir area in the interior of the cabinet 18 so as to maintain a level of water to provide maximum efficiency of water evaporation to form moist air.

A wicking element 22 is provided in the water reservoir. The wicking element 22 which also serves as a filter, has a large surface area of wick material which remains wet from contact with the water. The large area of wick material allows formation of moist air through evaporation of the water wicked by the wick material. On top of the wicking element 22 and affixed thereto is a closure 24 for an air path. The closure 24 allows channeling of the moist air upward through the closure 24 into another closure 26 for the air path. The closure 26 nests into the closure 24 so that if the wicking element 22 changes elevation as the water depth changes in the reservoir, the air path remains confined within the closures 24 and 26 thus preventing loss of moist air into the confines of the cabinet 18. The float gauge 138 rests on the bottom of the reservoir when no water is present and rises when water is present in the reservoir. The gauge 38 provides a signal when the reservoir is substantially empty. The closure 26 is affixed to the lid 28 of the humidifier 10, and surrounds the fans (not shown in this FIG.). This arrangement feeds the moist air directly to the fans for distribution into the area.

An electronic control unit 25 is situated between the two closures 26 and is affixed to the lid 28. The electronic unit 25 lies beneath the lift panel 14 shown in FIG. 1.

Figure 3:
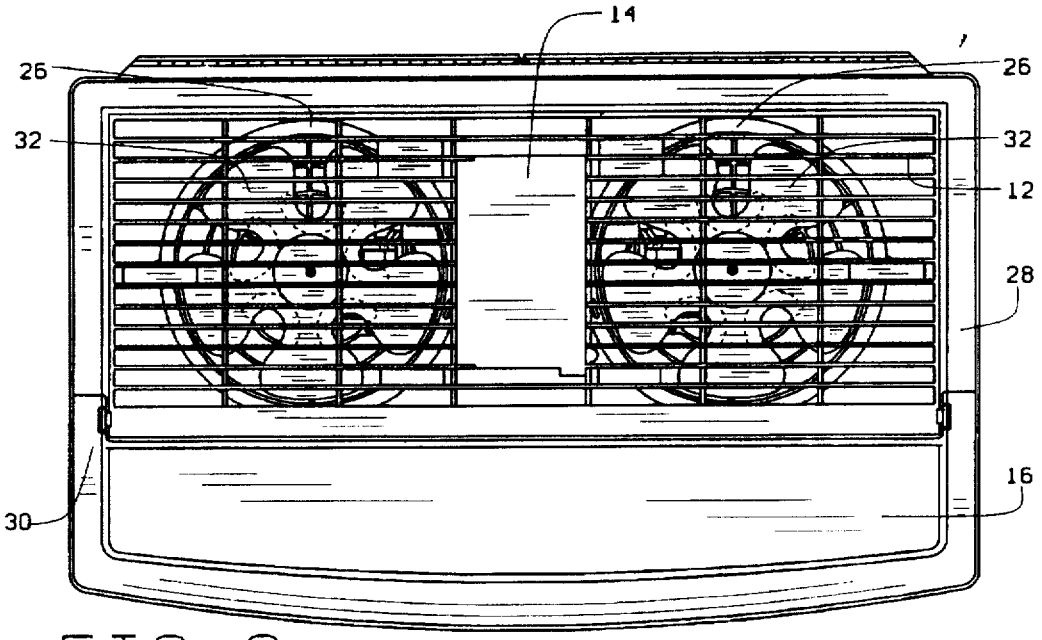
FIG. 3 is a top view of an embodiment of the present invention.

FIG. 3 is a top view of the humidifier 10 showing the lid 28 with the lift panel 16 with a hinge 30 allowing removal of the storage bottles 20 which reside below. Two fans 32 are mounted within the closures 26 so as to draw moist air upward through the closures 24 and 26 and distribute the moist air through louvers 12 into the room. It will be noted that the two fans 32 are located in a rear area space of the humidifier 10 while the lift panel 16 is located in a front area space that provides a front access space or opening for receiving the water storage bottles 20 or for hand filling of the humidifier 10, as may be desired. The humidifier 10 has a generally rectangular shape with the aforementioned rear area space and front area space each having generally rectangular shapes defining the overall generally rectangular shape of the humidifier 10. Locating the two fans 32 in the rear area space while providing a water filling front space access or opening in the front area space not only provides a better utilization of space, but eliminates problems associated with side water filled humidifiers which are difficult to fill as well as the position next to other furniture in a room.

Figure 4:
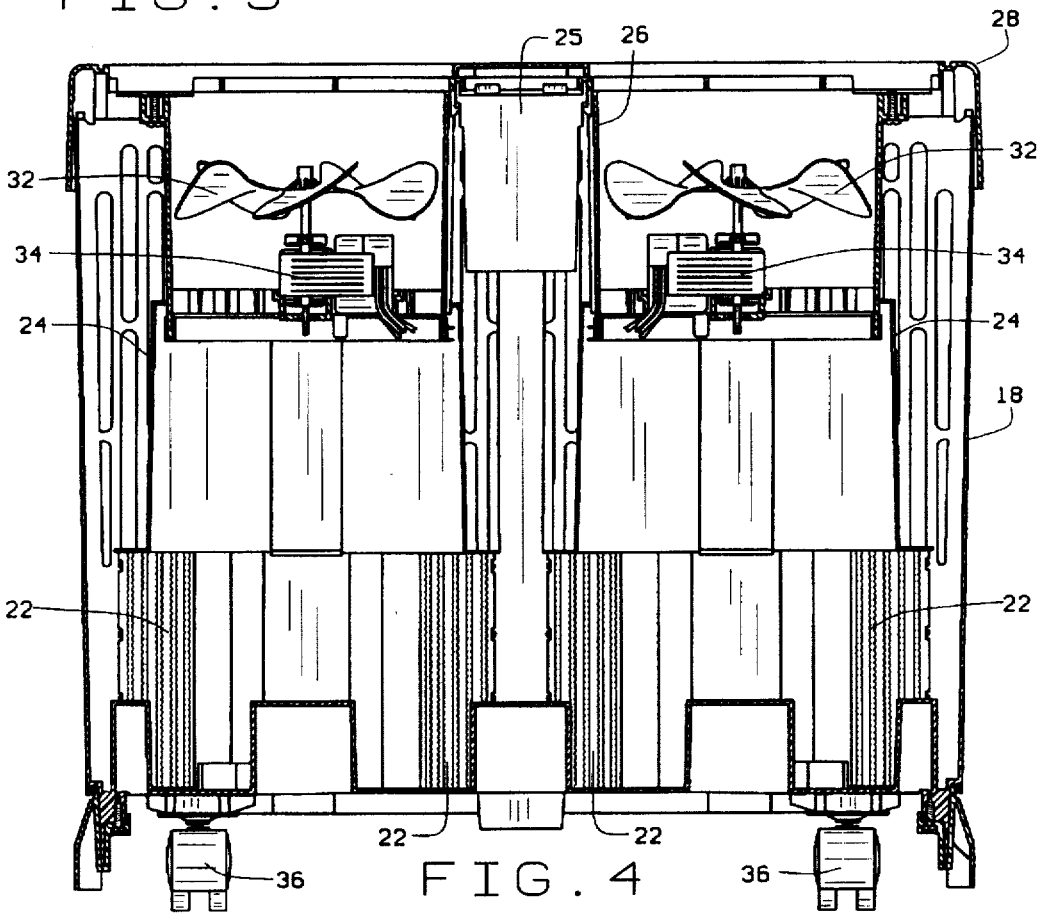
FIG. 4 is a front elevational view of an embodiment of the present invention.

FIG. 4 clearly shows the relationship of the fans 32 one to another within the cabinet 18. The fans 32 and their motors 34 are affixed to the lid 28 and mounted within the closures 26. The electronic control unit 25 is mounted between the closures 26 and all three are mounted to the lid 28. The position of the wicking element 22 and the closure 24 is shown when the water reservoir is substantially empty. The cabinet 18 is mounted on wheels 36 for easy movement about the area.

Figure 5:
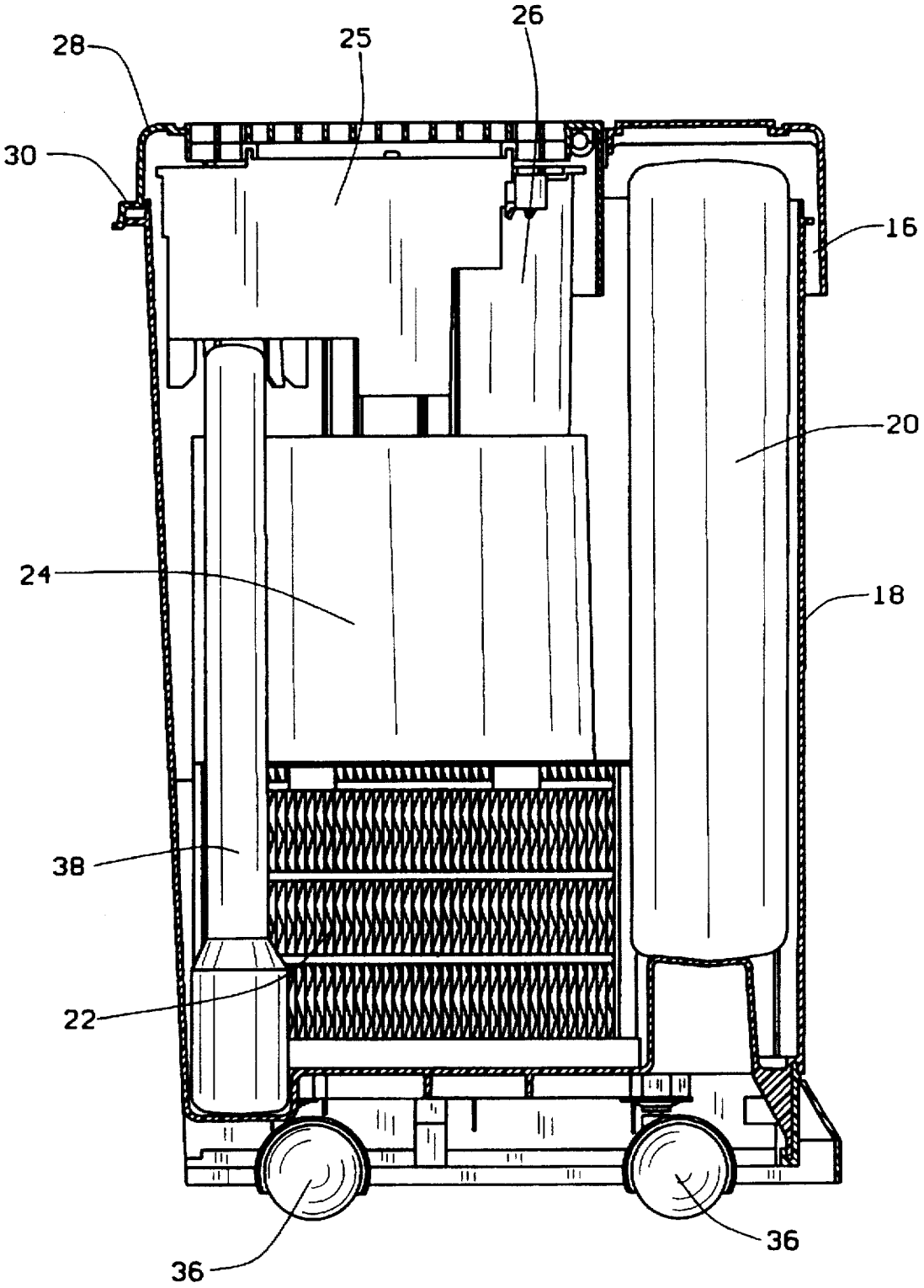
FIG. 5 is a side elevational view of one side of an embodiment of the present invention.

FIG. 5 illustrates the humidifier 10 from a side view exposing the major elements of the humidifier. Again the wicking element 22 is depicted in a resting position on the bottom of the cabinet 18. A float 38 is also shown in a resting position attained when the cabinet is substantially empty of water. The float 38 interfaces with the electronic control unit 25 to indicate when the water level is too low and the bottles 20 need refilling. The wicking element 22 also serves as a water filter to prevent water impurities from leaving a sediment in the humidifier. The wicking element 22 is removable so that the element can be replaced. The primary purpose of the wicking element is to wick water from the reservoir causing a large area to be wet thereby increasing the surface area from which water evaporates into moist air.

Figure 6:
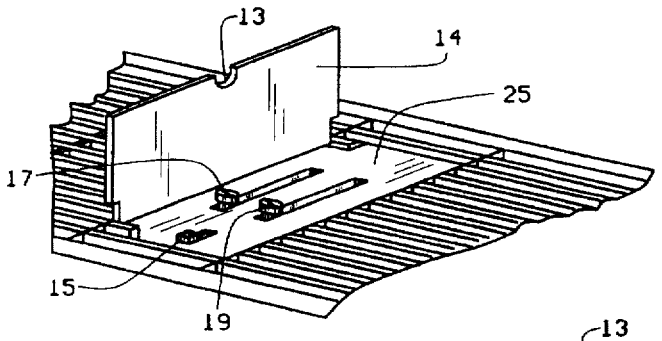
FIG. 6 is a perspective view of a portion of the top of one embodiment of the present invention.
Figure 7:
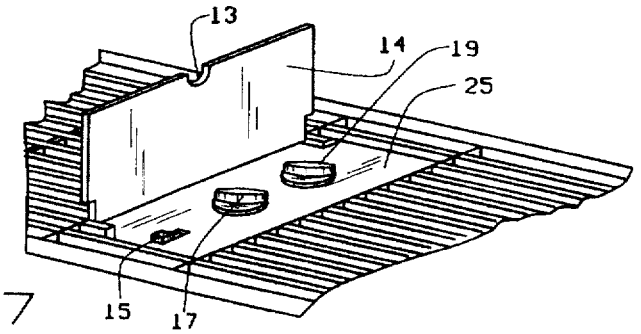
FIG. 7 is a perspective view of a portion of the top of another embodiment of the present invention.

FIGS. 6 and 7 show the electronic control unit 25 in detail depicting two embodiments. The unit 25 in FIG. 6 has a switch 15 which turns both fans off, or turns one fan on or both fans on. The unit 25 utilizes a slide control 17 to change the speed of the fan(s). Another slide control 19 regulates the humidity desired.

In FIG. 7, the fan control is a knob 17 having different positions depending on the number of speeds of the fan. The humidistat 19 is also a knob control and the switch 15 for the fans is the same as in FIG. 6.

Figure 8:
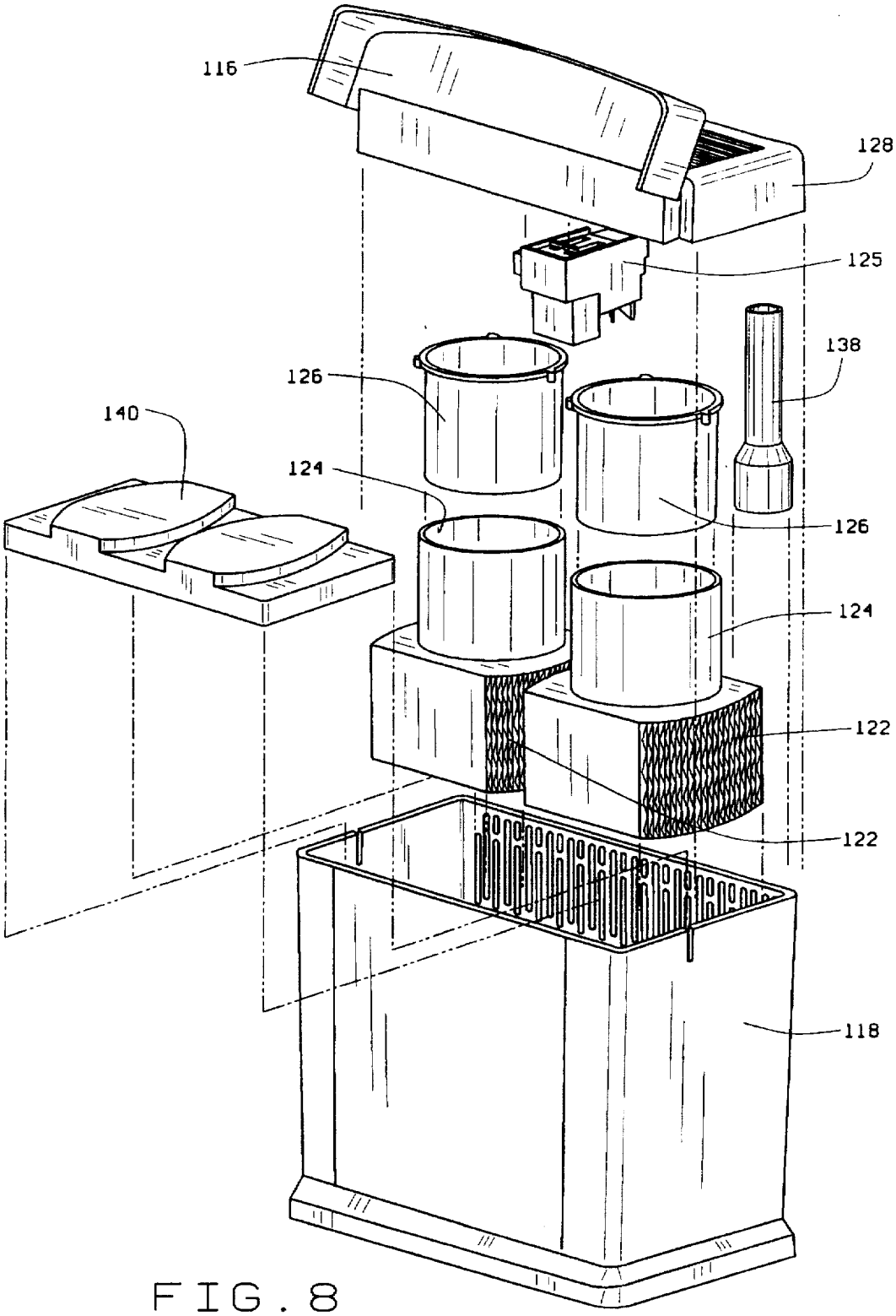
FIG. 8 is an exploded view of a further embodiment of the present invention.

Another embodiment is shown in FIG. 8 wherein an exploded view illustrates the "bucket fill" humidifier having a cabinet 118 which also serves as a reservoir for water. At the base of the cabinet inside is a float 140 upon which the wicks 122 rest. When the water level rises when the reservoir is filled the wicks 122 also rise so as to expose only the desired amount of the wick 122 to contact with the water. As the wicks 122 rise the lower air path closures 124 also rise surrounding the upper air path closures 126 to prevent escape of the moist air. The combination of closure 124 and closure 126 provides an extending and contracting closure as the water level changes in the reservoir. See U.S. Pat. No. 4,865,775 which is hereby incorporated by reference. The control unit 125 is located between the upper closures 126. The lid 128 is fashioned in the same manner as the lid in FIG. 2 the present lid 128 having a front lifted portion 116 which allows filling of the reservoir with a bucket or other water holding vessel.

The humidifiers of the prior art containing only one fan provided very little flexibility with respect to air movement. For instance, a typical fan could have a maximum speed so as to move about 1000 cfm of moist air. Even the lowest speed, about 500 cfm, may be more than is necessary to maintain the humidity level in an area once the desired level is reached. Furthermore, the speed of the fan blades can create an undesirable noise. The lowest speed of the typical single fan results in movement of air at least about 250 cfm. This speed cannot be reduced significantly because of the starting torque requirements of the motor at low speed.

When two or more fans are staged, as in the embodiments shown in the drawings, a maximum movement of air reaches 1000 cfm or more assuming the maximum speed of each fan provides about 500 cfm or more of moist air. At the same time, the minimum movement of air is as low as 100 cfm, assuming the low speed of one fan is 100 cfm in the present example. Even at maximum speed of two fans, the noise level is not noticeably higher than the single fan at 500 cfm and the noise level at lower speeds with two or more fans is reduced considerably.

Another embodiment of the present invention utilizes two or more air blowing devices having different capacities. For example, one fan might have a capacity of moving air at a rate of 500 cfm and the other fan a capacity of 1000 cfm. Thus the larger capacity fan would be used to rapidly transport moist air and the smaller fan would be utilized to maintain the humidity level. Of course, both fans can be used to even more rapidly transport moist air.

An entire residence can be humidified to a desired level by a single humidifier of the present invention. Types of humidifiers include table models, console models and the like. By staging multi-fans in a single humidifier as much as 12 to 14 gallons of water can be evaporated to form moist air which is then transported into the area e.g., a residence, in a period of 24 hours. On the other hand when the desired level of humidity has been reached, it can be maintained by transport of moist air at a rate as small as 100 cfm by the very same humidifier. When the thermostat is turned down at night in the typical residence, the humidifier needs only to be on very low speed to maintain the humidity level of the decreasing temperature thus providing a quiet atmosphere for sleeping. When the temperature is elevated the next morning upon the residents' wakening, the humidifier can quickly raise the humidity level to meet the increase in temperature. Though the noise level increases with multi-fans operating at a high speed, it does not take very long for the humidity to reach the desired level and the humidifier can then operate at the maintenance level returning to the quieter, slower speed.

We claim:

1. A humidifier including a water reservoir, a humidification system for converting the water from the water reservoir into moist air within the humidifier, at least two air moving devices positioned relative to the humidification system for transporting the moist air outside the humidifier, said at least two air moving devices being controlled by one operating control and one speed control, said one operating control energizing one or all of the air moving devices to change the amount of moist air transported outside the humidifier and the noise level dependent on the operation of one or all of the air moving devices, and said one speed control being interconnected to the one operating control for selective increasing or decreasing speed of one or both of said air moving devices.

2. A humidifier including a water reservoir, a humidification system for converting the water from the water reservoir into moist air within the humidifier, at least two air moving devices positioned relative to the humidification system for transporting the moist air outside of the humidifier, one operating control for selectively operating one or all of the air moving devices, one speed control interconnected to the one operating control for selectively increasing or decreasing the speed of one or all of the air moving devices, and one humidity control interconnected to the one operating control for humidifying water into moist air over a predetermined range when one or all of the air moving devices are in operation.

3. The humidifier as defined in claim 2 wherein the operating control is a switch which turns on one air moving device in one position and both air moving devices in a second position.

4. The humidifier as defined in claim 3 wherein the switch is a slide switch operating between the two switch positions.

5. The humidifier as defined in claim 3 wherein the switch is a rocker switch operating between the two switch positions.

6. A humidifier including a water reservoir, a humidification system for converting the water from the water reservoir into moist air within the humidifier, at least two air moving devices positioned relative to the humidification system for transporting the moist air outside of the humidifier, one operating control for the air moving devices to selectively operate one or all of the air moving devices, and one speed control for the air moving devices that is interconnected to the one operating control for selectively increasing or decreasing the speed of one or all of the air moving devices at various pre-selected speeds.

7. The humidifier as defined in claim 6 wherein the pre-selected speeds for the speed control includes at least two speeds.

8. The humidifier as defined in claim 6 wherein the pre-selected speeds for the speed control includes low, medium and high speeds.

9. The humidifier as defined in claim 6 wherein the speed control is a slide control operating between predetermined minimum and maximum speeds.

10. The humidifier as defined in claim 6 wherein the speed control is a rotary control operating between predetermined minimum and maximum speeds.

11. The humidifier as defined in claim 6 where the air moving devices are fans.

12. The humidifier as defined in claim 6 and further including one humidity control that is interconnected to the one operating control for humidifying water into moist air over a predetermined range when one or all of the air moving devices are in operation.

13. The humidifier as defined in claim 12 wherein the humidity control operates at a pre-selected humidity range between a predetermined minimum and maximum.

14. The humidifier as defined in claim 13 wherein the humidity control is a slide control operating between a predetermined minimum and maximum humidity range.

15. The humidifier as defined in claim 13 wherein the humidity control is a rotary control operating between a predetermined minimum and maximum humidity range.

16. A humidifier including a water reservoir with at least two air moving devices positioned relative to a humidification system for converting water from the water reservoir into moist air within the humidifier, the humidifier having a rear area and a front area, the at least two air moving devices being located in the rear area, and the front area providing an access space for water filling.

17. The humidifier as defined in claim 16 in which the humidifier is generally rectangularly shaped, the rear area and front area providing generally rectangularly shaped areas of the generally rectangularly shaped humidifier.

18. The humidifier as defined in claim 16 in which the front area provides an access space for receiving at least one water storage bottle.

19. The humidifier as defined in claim 16 in which the front area provides an access space defining a water filling opening for emptying water into the humidifier.

20. The humidifier as defined in claim 16 including means for operating one or both of the at least two air moving devices, the noise level being dependent on the operation of one or all of the air moving devices.

21. A humidifier including a water reservoir, a humidification system for converting water from the water reservoir into moist air within the humidifier, at least two air moving devices positioned relative to the humidification system for transporting the moist air outside the humidifier, said at least two air moving devices being controlled for operation of one or all of the air moving devices to change the amount of moist air transported outside the humidifier and the noise level dependent on the operation of one or all of the air moving devices, and said at least two air moving devices being located in a predetermined confined space in a rear area of the humidifier in order to provide a front access space in the humidifier for water filling.

22. The humidifier as defined in claim 21 in which the humidifier has a general rectangular shape, the predetermined confined space in the rear area of the humidifier in which the at least two air moving devices are located and the front access space each also having generally rectangular shaped areas forming the generally rectangular shape of the humidifier.

* * * * *